US009624001B1

(12) United States Patent
Hill

(10) Patent No.: US 9,624,001 B1
(45) Date of Patent: Apr. 18, 2017

(54) DRIP COLLAR FOR WINE BOTTLES AND THE LIKE

(71) Applicant: Kirk Hill, San Francisco, CA (US)

(72) Inventor: Kirk Hill, San Francisco, CA (US)

( * ) Notice: Subject to any disclaimer, the term of this patent is extended or adjusted under 35 U.S.C. 154(b) by 0 days.

(21) Appl. No.: 14/613,322

(22) Filed: Feb. 3, 2015

(51) Int. Cl.

| | |
|---|---|
| ***B65D 23/06*** | (2006.01) |
| *A41D 27/24* | (2006.01) |
| *A41D 3/04* | (2006.01) |
| *A41D 27/00* | (2006.01) |
| *A41D 27/10* | (2006.01) |
| *B65D 47/40* | (2006.01) |
| *A62B 17/00* | (2006.01) |

(52) U.S. Cl.
CPC ..... *B65D 23/065* (2013.01); *A41D 3/04* (2013.01); *A41D 27/00* (2013.01); *A41D 27/10* (2013.01); *A41D 27/24* (2013.01); *A41D 27/245* (2013.01); *A62B 17/006* (2013.01); *B65D 23/06* (2013.01); *B65D 47/40* (2013.01)

(58) Field of Classification Search
CPC ..... A41D 27/00; A41D 27/10; A41D 27/24; A41D 27/245; A41D 3/04; A41D 13/012; A41D 2300/32; A62B 17/006; B65D 23/06; B65D 47/40
USPC ..... 215/392; 222/108; 229/89; 220/DIG. 21, 739, 744; 2/457, 2.15, 2/2.17, 82, 161, 7, 59
See application file for complete search history.

(56) References Cited

U.S. PATENT DOCUMENTS

| | | | | |
|---|---|---|---|---|
| 422,814 | A * | 3/1890 | Loehr | A41D 3/04 2/87 |
| 2,745,569 | A * | 5/1956 | Seaman | A61J 9/08 215/11.1 |
| D178,124 | S | 6/1956 | Haslett | |
| 5,084,932 | A | 2/1992 | Zanchi | |
| D365,024 | S | 12/1995 | DuBow | |
| D460,356 | S | 7/2002 | Koenig | |
| 6,718,733 | B2 | 4/2004 | Kilmartin | |
| D543,844 | S | 6/2007 | Cook et al. | |
| D563,784 | S * | 3/2008 | Swartz | D9/434 |
| 8,104,636 | B2 * | 1/2012 | Crain | B65D 81/3876 206/524.1 |
| 8,347,532 | B1 | 1/2013 | Johnson | |
| D689,339 | S | 9/2013 | Bodechon | |
| 2011/0253575 | A1 * | 10/2011 | Addis | A47G 7/085 206/457 |
| 2014/0339244 | A1 * | 11/2014 | Arnold | B65D 81/3886 220/739 |

FOREIGN PATENT DOCUMENTS

| | | | |
|---|---|---|---|
| GB | 2224260 | A | 2/1990 |

* cited by examiner

*Primary Examiner* — Fenn Mathew
*Assistant Examiner* — Elizabeth Volz
(74) *Attorney, Agent, or Firm* — Law Offices of Ita D. Blecker, P.C.

(57) ABSTRACT

Drip collar which includes a tubular sleeve body that is made of a flexible material having an open first end and an open second end, the first end having a surface extending around an entire circumference of the sleeve body that is perpendicular to a longitudinal axis of the sleeve body. The first end of the sleeve body further having a drip kerchief contiguous with the surface of the first end, the drip kerchief comprising a folded-over portion (1) extending around the circumference of the first end, and (2) extending from the first end towards the second end.

18 Claims, 9 Drawing Sheets

DRIP COLLAR FOR WINE BOTTLES AND THE LIKE

BACKGROUND

The present invention pertains to the field of drip collars for bottles, and, more particularly, pertains to drip collars for use on wine bottles, liquor bottles, soda bottles, other beverage bottles, olive oil bottles and vinegar bottles that may catch drips of liquid after the liquid has been poured.

Wine and other liquids are meant to be poured from bottles containing the wine or other liquids. The wines or other liquids often have propensities to drip after pouring to stain tablecloths, clothing as well as the bottles and labels of the bottles because of residual amounts of liquids remaining at the tops of the bottles after the wine or other liquids are poured when served.

Various attempts have been made to avoid or at least reduce the propensity for dripping. For example, servers at restaurants and at parties often carry a napkin or small towel to wipe excess liquid from the tops of the bottles after each serving. To avoid this inconvenience, products have been proposed to attach to the bottles to catch the excess liquid. These products may be difficult to use, unsanitary, not reusable or not aesthetically pleasing.

BRIEF SUMMARY

The various advantages and purposes of the exemplary embodiments as described above and hereafter are achieved by providing, according to a first aspect of the exemplary embodiments, a drip collar which includes a tubular sleeve body of a flexible material having an open first end and an open second end, the first end having a surface extending around an entire circumference of the sleeve body that is perpendicular to a longitudinal axis of the sleeve body. The first end further having a drip kerchief contiguous with the surface of the first end, the drip kerchief comprising a folded-over portion (1) extending around the circumference of the first end, and (2) extending from the first end towards the second end.

According to a second aspect of the exemplary embodiments, there is provided a drip collar which includes a sleeve body of a flexible material having a stitched area that extends longitudinally on the sleeve body along an entire length of the sleeve body and parallel to a longitudinal axis of the sleeve body. The sleeve body having an open first end and an open second end, the first end having a surface extending around an entire circumference of the sleeve body that is perpendicular to the longitudinal axis of the sleeve body. The first end further having a drip kerchief contiguous with the surface of the first end, the drip kerchief comprising a folded-over portion (1) extending around the circumference of the first end, and (2) extending from the first end towards the second end.

According to a third aspect of the exemplary embodiments, there is provided a drip collar which includes a sleeve body of a flexible material having an open first end and an open second end, the first end having a surface extending around an entire circumference of the sleeve body that is perpendicular to a longitudinal axis of the sleeve body. The first end further having a drip kerchief contiguous with the surface of the first end, the drip kerchief comprising a folded-over portion (1) extending around the circumference of the first end, and (2) extending from the first end towards the second end. The drip collar further includes a sleeve extension portion extending from the second end, the sleeve extension portion having an inside surface as a contiguous extension of an inside surface of the sleeve body and an outside surface as a contiguous extension of an outside surface of the sleeve body, the extension portion further having a loop on the outside surface of the sleeve extension portion.

BRIEF DESCRIPTION OF SEVERAL VIEWS OF THE DRAWINGS

The features of the exemplary embodiments believed to be novel and the elements characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

FIG. 2A is a front view, FIG. 2B is a back view, FIG. 2C is a side view and FIG. 2D is a top view.

FIGS. 7A and 7B are illustrations of a fifth exemplary embodiment of the drip collar wherein FIG. 7A is a side view and FIG. 7B is a top view.

FIGS. 8A to 8C are illustrations of a sixth exemplary embodiment of the drip collar wherein FIG. 8A is a front view, FIG. 8B is a back view and FIG. 8C is a side view.

FIGS. 9A and 9B are illustrations of a seventh exemplary embodiment of the drip collar wherein FIG. 9A is a side view that is partly turned to the front, and FIG. 9B is a back view that is turned partly to the side.

DETAILED DESCRIPTION

The present exemplary embodiments are directed to a drip collar that is functionally superior to prior art drip collars. The present drip collar, in addition to preventing drips from wine bottles and the like, is able to be placed on the bottle without contaminating the pouring area. In various embodiments, the drip collar may have pull tabs for putting on the drip collar and for taking it off, exposed stitching for forming the drip collar and a drip collar extension for holding a cork or cap or similar device. In addition, the present drip collar is aesthetically pleasing in design, is adjustable and caters to the shape of different wine bottles and the like.

Figure 1:
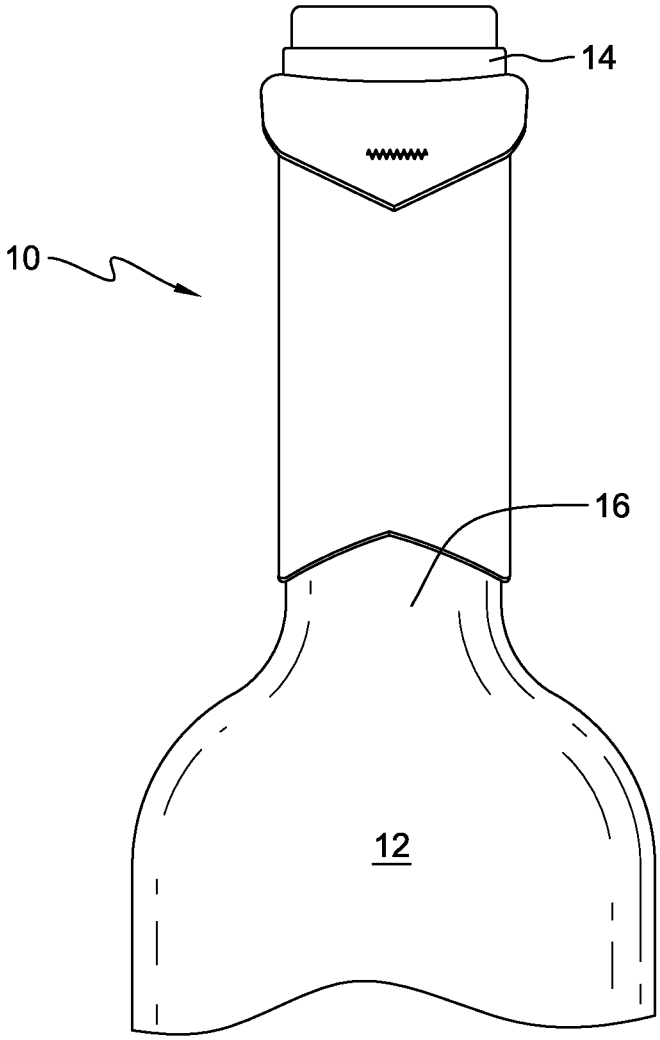
FIG. 1 is an illustration of a first exemplary embodiment of the drip collar having a drip kerchief on a wine bottle.

Referring to the Figures in more detail, and particularly referring to FIG. 1, there is illustrated a first exemplary embodiment of the drip collar 10 on a wine bottle 12. It should be understood that while the exemplary embodiments may be particularly useful with wine bottles, the exemplary embodiments may also be applicable to uses on other bottles such as liquor bottles, soda bottles, olive oil bottles and vinegar bottles, to name a few, but should not limited to use on such bottles. The remaining description of the exemplary embodiments will focus on use of the exemplary embodiments in connection with wine bottles but it should be understood that use of the exemplary embodiments should not be limited to just wine bottles and in fact may be used on the other types of bottles listed above as well as those types of bottles not specifically mentioned herein.

Typical wine bottles, such as wine bottle 12, have an enlarged portion 14 (partially covered by the drip collar 10) where the wine is poured out. The drip collar 10 must be flexible enough to pass over the enlarged portion 14 and then fit snugly on the neck 16 of the wine bottle 12. The material of the drip collar 10 should, in addition to being flexible and somewhat elastic, is preferably also absorbent as well as reusable. In a particularly preferred exemplary embodiment, the drip collar 10 may be washed after use to remove any drips of liquid that have been absorbed by the drip collar 10. One particularly preferred material is neoprene, preferably in a thickness of about 1.5 mm.

Referring now to FIGS. 2A to 2D, the drip collar 10 is shown in more detail. FIGS. 2A to 2D of the drip collar 10 have been drawn as if the drip collar 10 were on the wine bottle 12 so that the drip collar takes on the shape of the bottle. The drip collar 10 includes a sleeve body 18 comprising the flexible material. The sleeve body 18 is essentially tubular having a uniform width along its length so that it may fit on the wine bottle 12 but since it is made of a flexible material, it may appear flattened when not on the wine bottle 12. The sleeve body 18 has an open first end 20 and an open second end 22. The first end 20 has a surface 24 (see FIG. 2D) extending around an entire circumference of the sleeve body 18 that is perpendicular to a longitudinal axis 26 (see FIG. 2A) of the sleeve body 18.

The drip collar 10 further includes a folded over portion 28 contiguous with the surface 24 of the first end 20. Folded over portion 28 is hereafter referred to as a drip kerchief. The drip kerchief 28 wraps around the circumference of the first end 20 (see FIG. 2D) and extends from the first end 20 towards the second end 22. As shown in FIGS. 2B and 2D, the drip kerchief 28 may not wrap entirely around the circumference of the first end 20. That is, as shown for example in FIG. 2A, the drip kerchief 28 is folded over from the first end 20 so as to protrude towards the second end 22. The drip kerchief 28 in this exemplary embodiment further has a longitudinal dimension determined along the longitudinal axis 26 that varies from about zero at one point 30 (see FIGS. 2B and 2D) on the circumference of the first end 20 to a maximum at a second point 32 (see FIGS. 2A, 2C and 2D) on the circumference of the first end 20 and back to about zero at the one point 30 on the circumference of the first end 20. In other words, the drip kerchief 28 in this exemplary embodiment is not uniform in longitudinal dimension and varies in longitudinal dimension around the circumference of the sleeve body 18. At point 30 on the circumference, the longitudinal dimension of the folder over portion 28, as measured from the first end 20 towards the second end 22, should be zero but due to manufacturing tolerances, the longitudinal dimension at point 30 may actually be slightly more than zero but no more than the thickness of the material of the sleeve body 18. The longitudinal dimension of the drip kerchief 28 gradually increases around the circumference until it reaches a maximum at point 32 which is approximately 180 degrees around the circumference from point 30.

The drip kerchief 28 may be tacked 29, such as by stitching, to sleeve body 18.

The drip kerchief 28 is important for a number of reasons. The drip kerchief 28 is most absorbent and thus makes a natural pouring area, particularly at the thickest part of the drip kerchief 28. The drip kerchief 28 is also important from the standpoint of manufacturability.

In other exemplary embodiments, the design of the drip kerchief enables pull tabs and in the exemplary embodiment in which the sleeve body 18 is stitched, the drip kerchief 28 directs the pouring towards the thickest portion of the drip kerchief 28 and away from the stitched area since constant exposure of the stitched area to the poured liquid can cause deterioration and contamination of the stitched area.

Figure 2A:
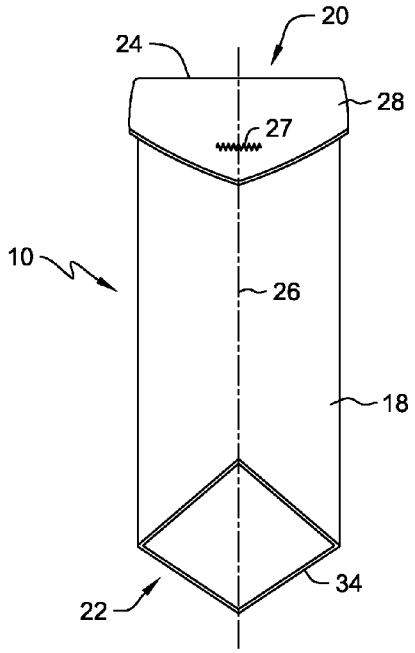
FIGS. 2A to 2D are illustrations of the first exemplary embodiment of the drip collar where
Figure 2B:
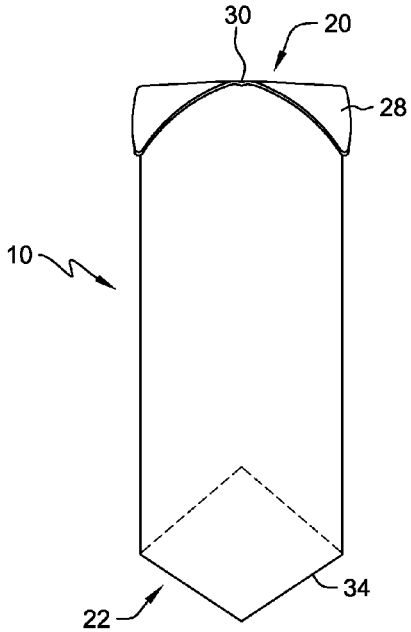
Figure 2C:
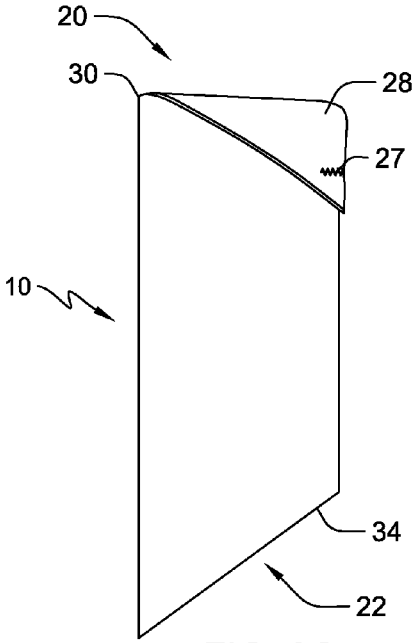
Figure 2D:
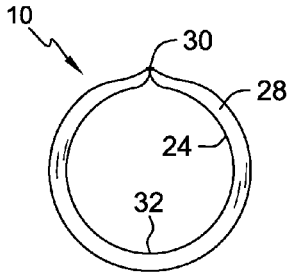

Also illustrated in FIGS. 2A, 2B and 2C, the surface 34 of second end 22 may not be perpendicular to the longitudinal axis 26 of the sleeve body 18. Surface 34 is shown as being at an angle to the longitudinal axis 26. Making surface 34 angular may enable better fit with the wine bottle 12, and create more finger room for ease of sliding the drip collar 10 onto the wine bottle thus not having to touch any pouring area.

Drip collar 10 shown in FIGS. 1 and 2A to 2D is a first exemplary embodiment that includes several important features as previously described.

Figure 3:
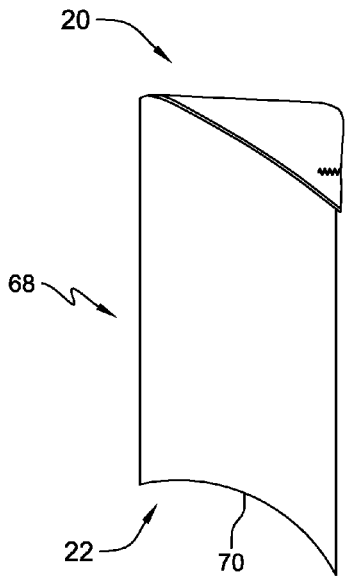
FIG. 3 is a side view of a second exemplary embodiment.

Referring now to FIG. 3, there is shown a second exemplary embodiment of a drip collar 68. Drip collar 68 is similar to drip collar 10 of FIGS. 1 and 2A to 2D except that drip collar 68 has surface 70 at end 22 which is not straight but may be curved.

Figure 4A:
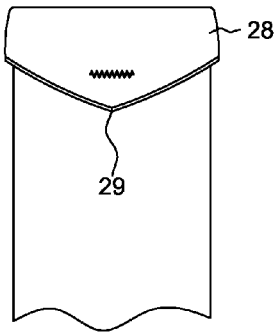
FIGS. 4A to 4C are front views of various alternative shapes of the drip kerchief.
Figure 4B:
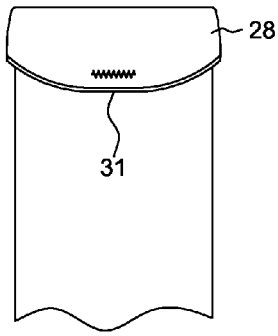
Figure 4C:
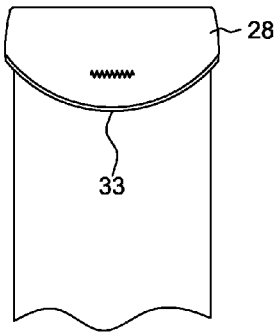

Referring now to FIGS. 4A to 4B, there are shown various additional shapes for the drip kerchief 28 shown in FIGS. 1 and 2A to 2D. In FIG. 4A, the drip kerchief comes to a point at 29. In FIG. 4B, the drip kerchief 28 has a flat surface 31 in front. In FIG. 4C, the drip kerchief 28 is rounded in front at 33.

Figure 5:
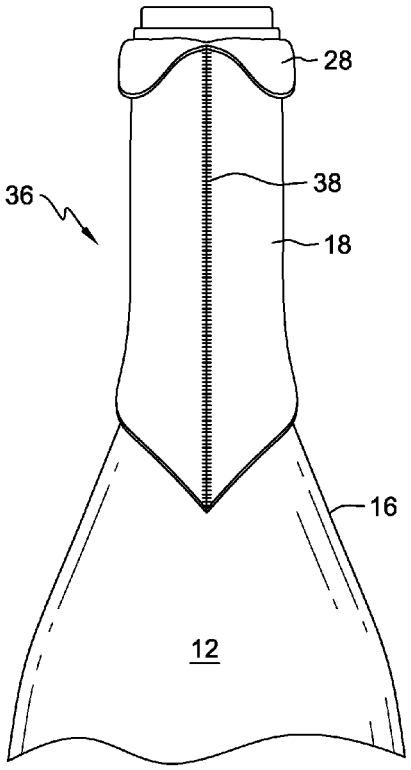
FIG. 5 is a back view of a third exemplary embodiment of the drip collar.

Referring now to FIG. 5, there is illustrated a third exemplary embodiment of a drip collar 36 shown on a wine bottle 12. In this exemplary embodiment, the drip collar 36 has been formed by cutting out a flat piece of flexible material and then sewing the cut ends together at stitched area 38. The stitch used in the stitched area 38 may be a butt seam stitch. A butt seam stitch allows the two cut ends of the sleeve body 18 to be stitched together without causing a raised stitched area. An advantage of the butt seam stitch is that it is flexible so as to lay flat on the wine bottle. It is most preferred that there be only one stitched area 38 extending parallel to the longitudinal axis (as seen in FIG. 2A) so that any liquid that is poured will be concentrated at the front of the drip kerchief 28 and away from the stitched area 38. As mentioned previously, continuous exposure of the stitched area 38 to liquids may cause deterioration and contamination of the stitched area 38. The present inventor believes that forming the drip collar 36 in this way is a novel way of forming the drip collar 36 as well as providing an aesthetically pleasing look both in form and function.

Figure 6:
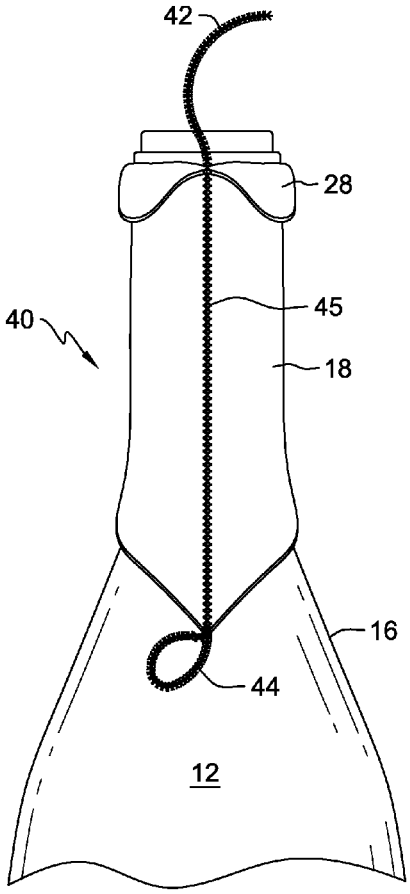
FIG. 6 is a back view of a fourth exemplary embodiment of the drip collar.

Referring now to FIG. 6, there is illustrated a fourth exemplary embodiment of a drip collar 40 shown on a wine bottle 12. In this exemplary embodiment, the drip collar 40 is similar to drip collar 36 in FIG. 5 in that the drip collar 40 has been formed by cutting out a flat piece of flexible material and then sewing the cut ends together at stitched area 45. The stitch used in the stitched area 45 may be an overlock stitch. An overlock stitch is a kind of stitch that sews over the edge of the two edges of the sleeve body 18 for edging, hemming, or seaming. The overlock stitch is a raised stitch. Again, it is most preferred that there be only one stitched area 45 extending parallel to the longitudinal axis (as seen in FIG. 2A) so that any liquid that is poured will be concentrated at the front of the drip kerchief 28 and away from the stitched area 45.

Besides the different stitching used, drip collar 40 differs from drip collar 36 in that drip collar 40 may contain one or more pull tabs 42, 44 in addition to stitched area 45. For ease of manufacture, pull tabs 42, 44 may be continuations of stitched area 45 when an overlock stitch is used which in and of itself is an advantage of the overlock stitch; in this exemplary embodiment, they may be referred to as threaded pull tabs. Alternatively and not as preferably, pull tabs 42, 44 may be separately attached to the drip collar by means other than continuation of the stitched area 45 such as stitching not being a continuation of the stitched area 45 or by gluing. The drip collar 40 may contain either pull tab 42 or pull tab 44 or both pull tab 42 and pull tab 44. Further alternatively, the pull tabs 42, 44 may be non-looped such as pull tab 42 or looped such as pull tab 44. In use, the pull tab 44 may be used to place the drip collar 40 on the wine bottle 12 and pull tab 42 may be used to remove the drip collar from the wine bottle 12.

While it is preferred for this exemplary embodiment to have the one or more pull tabs 42, 44, it is also within the scope of the exemplary embodiments for there to be no pull tabs at all.

Figure 7A:
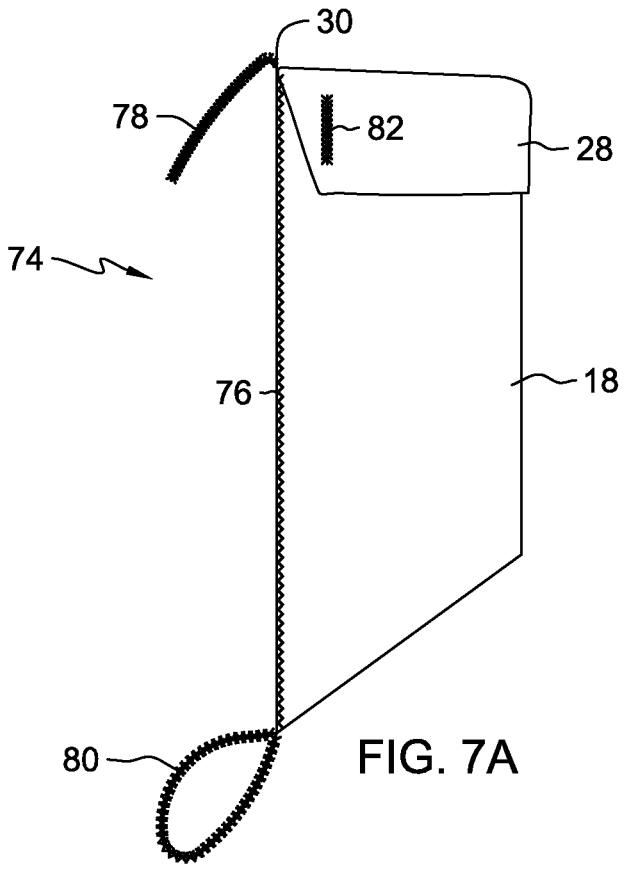
Figure 7B:
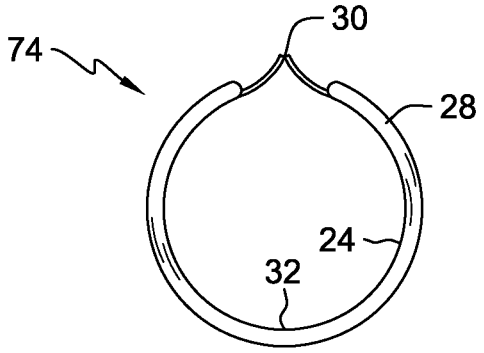

Referring now to FIGS. 7A and 7B, a fifth exemplary embodiment of a drip collar 74 is illustrated. This exemplary embodiment is similar to the drip collar 40 shown in FIG. 6 in that the drip collar 74 has an overlock stitched area 76 and threaded pulls 78, 80. However, drip kerchief 28 on drip collar 74 is different in that drip kerchief 28 is rectangular so that the longitudinal dimension measured along the longitudinal axis 26 (shown in FIG. 2A) is the same all around the circumference of the drip collar 74 except along the part of the circumference 30 where the drip kerchief does not extend. Drip kerchief 28 may be tacked to the sleeve body at 82 shown in FIG. 7A and preferably also tacked on the opposite side of the drip kerchief 28.

Figure 8A:
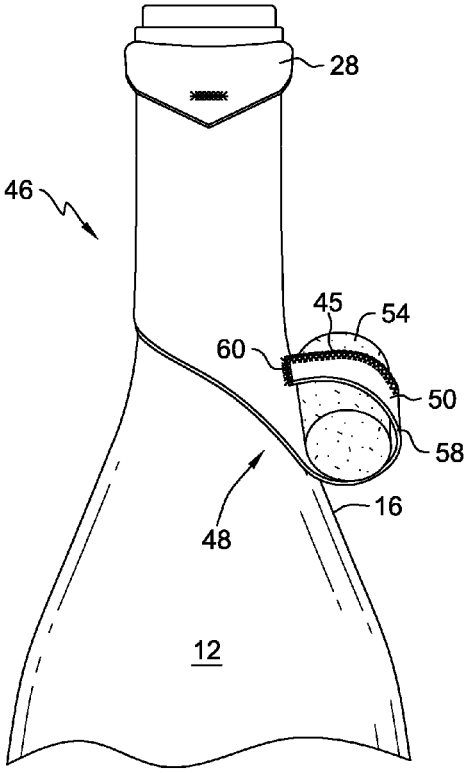
Figure 8B:
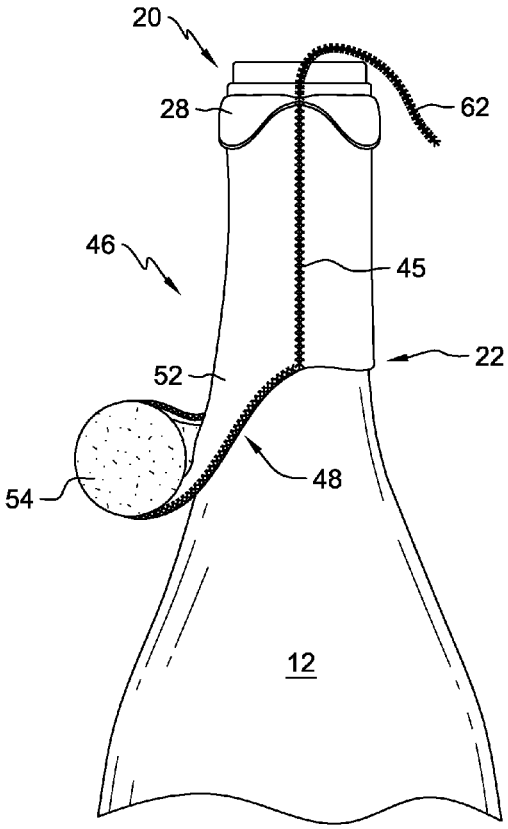
Figure 8C:
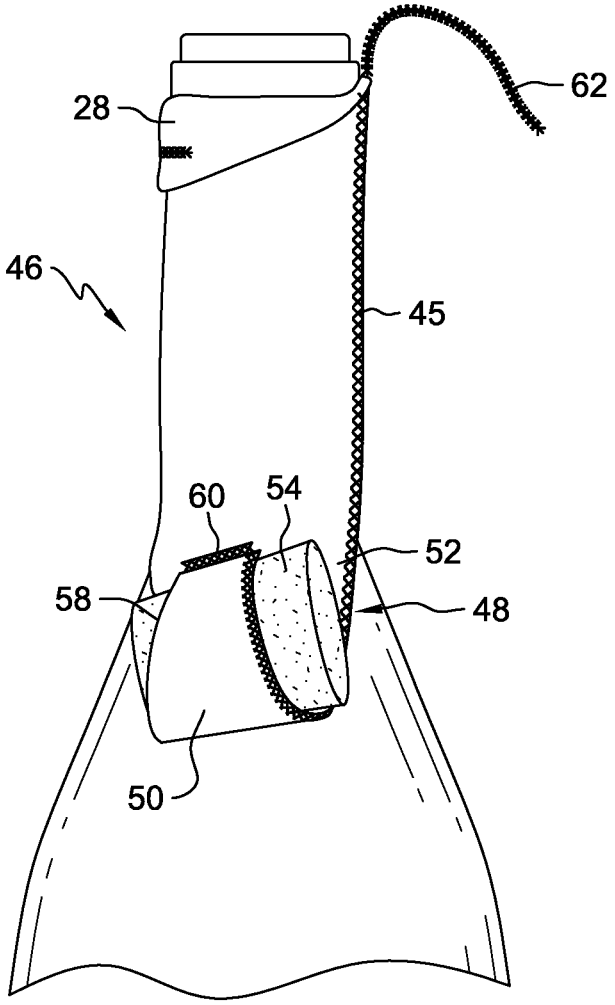

Referring now to FIGS. 8A to 8C, a sixth exemplary embodiment of a drip collar 46 is illustrated and shown on a wine bottle 12. Drip collar 46 is similar to drip collar 40 in FIG. 6 except that drip collar 46 contains a sleeve extension portion (hereafter cork holder) 48 that extends from the second end 22. While the sleeve body 18 is tubular as described previously, the cork holder 48 is not tubular. The cork holder 48 has an inside surface 50 as a contiguous extension of an inside surface of the sleeve body 18 and an outside surface 52 as a contiguous extension of an outside surface 56 of the sleeve body 18. The cork holder 48 further includes a loop 58 on the cork holder portion 48, preferably looped over so as to be on the outside surface 52. The loop 58 may be tacked 60 to outside surface 52. The loop 58 may be used to hold a cork 54 from a wine bottle just opened or a cap or other bottle enclosure. Alternatively loop 58 may hold a reusable cork which may be tapered, also shown as 54, to recork the bottle after some wine has been consumed. The loop 58 may be tapered to fit the tapered cork 54 or to hold a cap or other bottle enclosure.

The drip collar 46 may preferably include overlock stitching 45 which extends down into the cork holder 48 and around the loop 58. Further, drip collar 46 may contain threaded pull 62.

Figure 9A:
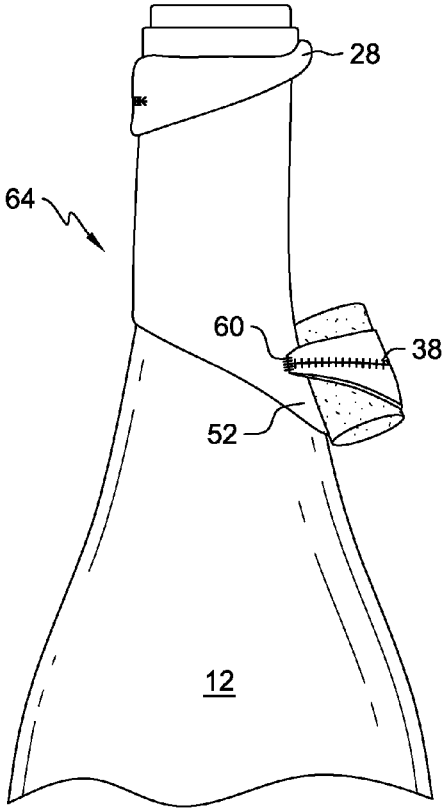
Figure 9B:
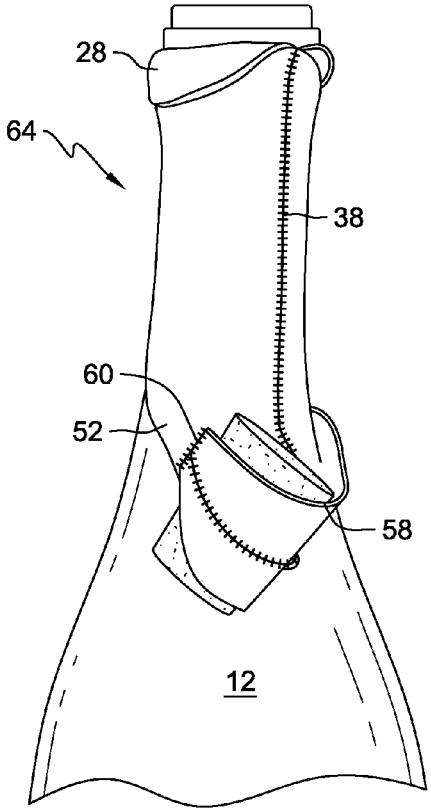

Referring now to FIGS. 9A and 9B, a seventh exemplary embodiment of a drip collar 64 is illustrated and shown on a wine bottle 12. Drip collar 64 is similar to drip collar 46 in FIGS. 8A and 8B except that drip collar 64 is fabricated using a butt seam stitch such as butt seam stitch 38 shown in FIG. 5.

As shown in FIG. 9B, the loop 58 has been tacked 60 offcenter to the outside surface 52 but the loop 58 may also be tacked to the center of outside surface 52. It should be understood that while drip collar 64 preferably contains stitched area 38, drip collar 64 may be formed without stitched area 38.

Figure 10:
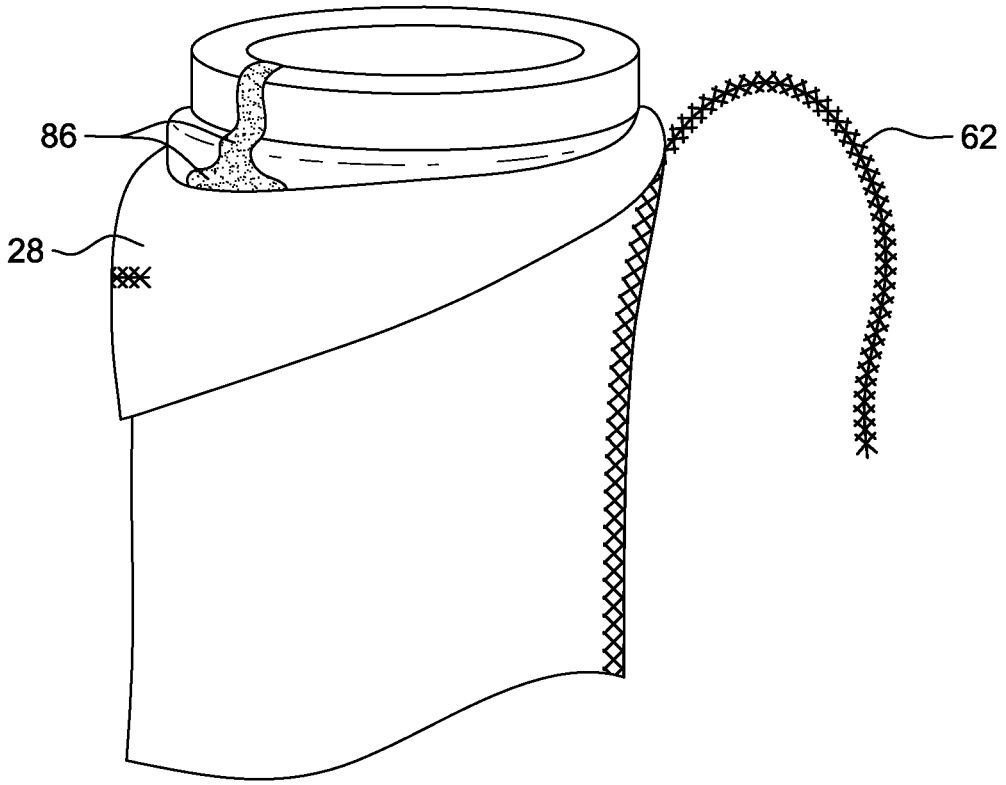
FIG. 10 illustrates an advantage of the exemplary embodiments in which the drip collar may catch drips of liquid left over after pouring liquid from a bottle.

FIG. 10 illustrates an advantage of the exemplary embodiments in which the drip collar may catch drips of liquid left over after pouring liquid from a bottle. For purposes of illustration and not limitation, the sixth embodiment of the drip collar is shown in FIG. 10 having a drip 86 which is caught by drip kerchief 28.

It will be apparent to those skilled in the art having regard to this disclosure that other modifications of the exemplary embodiments beyond those embodiments specifically described here may be made without departing from the spirit of the invention. Accordingly, such modifications are considered within the scope of the invention as limited solely by the appended claims.

What is claimed is:

1. A drip collar comprising:

a tubular sleeve body of a flexible material having an open first end and an open second end, the first end having a surface extending around an entire circumference of the sleeve body that is perpendicular to a longitudinal axis of the sleeve body, the tubular sleeve body having a uniform diameter along its length, the first end further having a drip kerchief contiguous with the surface of the first end, the drip kerchief comprising a folded-over portion (1) extending around the circumference of the first end, and (2) extending from the first end towards the second end, wherein the drip kerchief is tacked to the sleeve body to hold the entire drip kerchief tight against the sleeve body.

2. The drip collar of claim 1 wherein the drip collar is adapted to fit on the neck of a bottle.

3. The drip collar of claim 1 wherein the open second end has a curved surface.

4. A drip collar comprising:

a tubular sleeve body of a flexible material having an open first end and an open second end, the first end having a surface extending around an entire circumference of the sleeve body that is perpendicular to a longitudinal axis of the sleeve body, the first end further having a drip kerchief contiguous with the surface of the first end, the drip kerchief comprising a folded-over portion (1) extending around the circumference of the first end, and (2) extending from the first end towards the second end, and further comprising only a single stitched area that extends longitudinally on the sleeve body along an entire length of the sleeve body and parallel to the longitudinal axis and a threaded pull tab that extends from the single stitched area and from at least one of the first end and the second end.

5. The drip collar of claim 4 wherein the stitched area comprises a butt seam stitch.

6. The drip collar of claim 4 wherein the stitched area comprises an overlook stitch.

7. A drip collar comprising a tubular sleeve body of a flexible material having an open first end and an open second end, the first end having a surface extending around an entire circumference of the sleeve body that is perpendicular to a longitudinal axis of the sleeve body, the first end further having a drip kerchief contiguous with the surface of the first end, the drip kerchief comprising a folded-over portion (1) extending around the circumference of the first end, and (2) extending from the first end towards the second end; and a sleeve extension portion extending from the second end, the sleeve extension portion having an inside surface as a contiguous extension of an inside surface of the sleeve body and an outside surface as a contiguous extension of an outside surface of the sleeve body, the extension portion further having a loop on the outside surface of the sleeve extension portion.

8. A drip collar comprising:

a tubular sleeve body of a flexible material having an open first end and an open second end, the first end having a surface extending around an entire circumference of the sleeve body that is perpendicular to a longitudinal axis of the sleeve body, the tubular sleeve body having a uniform diameter along its length, the first end further having a drip kerchief contiguous with the surface of the first end the drip kerchief comprising a folded-over portion (1) extending around the circumference of the first end, and (2) extending from the first end towards the second end, wherein the drip kerchief having a dimension determined along the longitudinal axis that gradually varies from about zero at one point on the circumference of the first end to a maximum at a second point opposite from the one point on the circumference of the first end and gradually back from the second point to about zero at the one point on the circumference of the first end.

9. A drip collar comprising:

a sleeve body of a flexible material having only a single stitched area that extends longitudinally on the sleeve body along an entire length of the sleeve body and parallel to a longitudinal axis of the sleeve body, the sleeve body having an open first end and an open second end, the first end having a surface extending around an entire circumference of the sleeve body that is perpendicular to the longitudinal axis of the sleeve body, the first end further having a drip kerchief contiguous with the surface of the first end, the drip kerchief comprising a folded-over portion (1) extending around the circumference of the first end, and (2) extending from the first end towards the second end, wherein the drip kerchief having a dimension determined along the longitudinal axis that gradually varies from about zero at one point on the circumference of the first end to a maximum at a second point opposite from the one point on the circumference of the first end and gradually back from the second point to about zero at the one point on the circumference of the first end.

10. The drip collar of claim 9 wherein the stitched area comprises a butt seam stitch.

11. The drip collar of claim 9 wherein the stitched area comprises an overlock stitch.

12. The drip collar of claim 9 further comprising a threaded pull that directly extends from the stitched area at least one of the first end and the second end.

13. The drip collar of claim 9 wherein the drip kerchief is tacked to the sleeve body.

14. A drip collar comprising:

a sleeve body of a flexible material having only a single stitched area that extends longitudinally on the sleeve body along an entire length of the sleeve body and parallel to a longitudinal axis of the sleeve body, the sleeve body having an open first end and an open second end, the first end having a surface extending around an entire circumference of the sleeve body that is perpendicular to the longitudinal axis of the sleeve body, the first end further having a drip kerchief contiguous with the surface of the first end, the drip kerchief comprising a folded-over portion (1) extending around the circumference of the first end, and (2) extending from the first end towards the second end; and a sleeve extension portion extending from the second end, the sleeve extension portion having an inside surface as a contiguous extension of an inside surface of the sleeve body and an outside surface as a contiguous extension of an outside surface of the sleeve body, the extension portion further having a loop on the outside surface of the sleeve extension portion.

15. A drip collar comprising:

a sleeve body of a flexible material having an open first end and an open second end, the first end having a surface extending around an entire circumference of the sleeve body that is perpendicular to a longitudinal axis of the sleeve body, the first end further having a drip kerchief contiguous with the surface of the first end, the drip kerchief comprising a folded-over portion (1) extending around the circumference of the first end, and (2) extending from the first end towards the second end; and a sleeve extension portion extending from the second end, the sleeve extension portion having an inside surface as a contiguous extension of an inside surface of the sleeve body and an outside surface as a contiguous extension of an outside surface of the sleeve body, the extension portion further having a loop on the outside surface of the sleeve extension portion.

16. The drip collar of claim 15 further comprising only a single stitched area that extends longitudinally on the sleeve body along an entire length of the sleeve body and parallel to the longitudinal axis.

17. The drip collar of claim 15 further comprising a pull tab that extends from the first end.

18. The drip collar of claim 15 wherein the drip kerchief is tacked to the sleeve body to hold the entire drip kerchief tight against the sleeve body.

* * * * *